US005398939A

United States Patent [19]

Lee

[11] Patent Number: 5,398,939

[45] Date of Patent: Mar. 21, 1995

[54] ATTACHABLE MARKERS FOR TARGETS

[76] Inventor: James Lee, Blakewood, Black Gate Lane, Pulborough, West Sussex RH20 1DD, United Kingdom

[21] Appl. No.: 82,247

[22] Filed: Jun. 24, 1993

[30] Foreign Application Priority Data

Jun. 24, 1992 [GB] United Kingdom ..... 9213457
Aug. 21, 1992 [GB] United Kingdom ..... 9217758

[51] Int. Cl.[6] ..... F41J 9/16
[52] U.S. Cl. ..... 273/362
[58] Field of Search ..... 273/362, 363, 364, 365

[56] References Cited

U.S. PATENT DOCUMENTS

| | | | |
|---|---|---|---|
| 286,800 | 10/1883 | Fey | 273/364 X |
| 287,985 | 11/1883 | Woeber | 273/363 |
| 1,966,342 | 9/1932 | Gerdes | 273/362 |
| 2,653,026 | 3/1950 | Feltus | 273/362 |
| 2,835,073 | 5/1958 | Dame | 273/362 X |

FOREIGN PATENT DOCUMENTS

| | | |
|---|---|---|
| 890001 | 1/1944 | France . |
| 703997 | 2/1941 | Germany . |
| 2100107 | 2/1971 | Germany . |
| 391353 | 4/1933 | United Kingdom . |

*Primary Examiner*—William H. Grieb
*Attorney, Agent, or Firm*—Christopher John Rudy

[57] ABSTRACT

Markers for aerial targets, also known as clay pigeons, of the type which shatter when hit by one or more pellets. The marker may comprise a ring of resilient material having a wail adapted to engage outwardly the rim of a standard clay pigeon target; may take the form of a dished disk having an upwardly curving central portion which fits into the underside of a clay pigeon target and an upwardly directed wail which has an internal diameter substantially the same as the outer rim of such a target, or it may take the form of a simple annulus having inner and outer upwardly directed wails which engage the lower rim of the target and are maintained in position by frictional contact between the wails and the rim. The wall of the marker engaging outwardly the rim of a clay pigeon target may carry a series of incisions or be formed as a castellated ring. In an other embodiments, the marker may comprise a central disc-shaped core carrying a plurality of legs directed outwardly with feet adapted to engage the rim of a standard clay pigeon target by frictional and/or adhesive forces, or it may be a cap. The markers are constructed from a material with sufficient resilience to engage the rim of the target and which does not shatter such as metal, a synthetic resin polymer or a composition based thereon. A preferred synthetic resin is high impact polystyrene which may be painted or pigmented with a distinctive color.

19 Claims, 1 Drawing Sheet

ATTACHABLE MARKERS FOR TARGETS

FIELD OF THE INVENTION

This invention relates to aerial targets, also known as clay pigeons, of the type which shatter when hit by one or more pellets.

BACKGROUND TO THE INVENTION

Clay pigeon targets usually comprise saucer shaped discs formed of a frangible material. They are usually propelled tangentially from a launcher arm in a manner that imparts a spin. The trajectory of the target will depend on the angle and speed at launch. The launch is usually requested by a sportsperson armed with a shotgun who then discharges the weapon one or more times at the flying target with the object of destroying it. Partial or complete destruction of the target is normally determined by an observer who makes a record in accordance with the relevant category of shooting rules.

It has been proposed in GB-A-0 391 353 that a clay pigeon target may include a disc-like cardboard marker which separates and falls to the ground when the target is shattered. The proposed type of marker preferably carried tassels or streamers so that their fall simulated that of a dead bird. The material proposed for these markers, cardboard, was liable to be damaged or destroyed by shot at the same time as the main body of the target. Furthermore, as explained in the aforementioned patent specification, the markers were difficult to associate with the main target unless it was specially adapted for the purpose by the inclusion of projections or ribs in the underside of the disc. Furthermore, such targets carrying the markers could not be readily stacked in a launcher due to the projections and ribs.

For competitive clay pigeon shooting the weight and dimensions of the clay pigeon target must conform to internationally agreed specifications. The majority of targets commercially available are made to these specifications.

SUMMARY OF THE INVENTION

The present invention provides a marker for clay pigeon targets which is substantially resistant to shot damage and can be fitted to standard clay pigeon targets without modification. The targets fitted with the markers do not lose their ability to stack and the target may remain within the specified weight and dimensional tolerances.

According to the present invention there is provided a marker for a clay pigeon target comprising a ring of resilient material having a wall adapted to engage outwardly the rim of a standard clay pigeon target.

According to an alternative embodiment of the present invention there is provided a marker for a clay pigeon target comprising a central disc-shaped core carrying a plurality of legs directed outwardly with feet adapted to engage the rim of a standard clay pigeon target by frictional and/or adhesive forces.

DETAILED DESCRIPTION/DRAWINGS OF THE INVENTION

The marker according to the invention may take the form of a dished disk having an upwardly curving central portion which fits into the underside of a clay pigeon target and an upwardly directed wall which has an internal diameter substantially the same as the outer rim of such a target. The marker is held to the target by frictional contact and/or vacuum forces and is carried by it in flight.

In an alternative embodiment the marker takes the form of a simple annulus having inner and outer upwardly directed walls which engage the lower rim of the target and are maintained in position by frictional contact between the walls and the rim.

In all the embodiments the marker separates from the clay pigeon target when the latter is hit by sufficient pellets to cause it to shatter and falls to the ground together with the debris from the target. To assist identification and location the marker may be painted or pigmented with a distinctive colour.

The marker may be constructed from any material with sufficient resilience to engage the rim of the target and to resist shattering when hit by pellets. The marker may constructed from metal, a synthetic resin polymer or a composition based thereon. In the latter case the polymer may be nylon, polystyrene, polypropylene, cellulose acetate, cellulose butyrate, cellulose acetate-butyrate, polyvinyl chloride, polyvinylacetal, polycarbonate, polypropylene, polyacrylic acids or esters including copolymers such as ABS. The compositions may contain such a synthetic resin in combination with an organic or inorganic filler such as textile fibres, glass fibre or cellulose fibres. In preferred embodiments the synthetic resin composition is photo- or bio-degradable. The synthetic resin markers may be reused if undamaged by pellets, and metal markers may similarly be reused.

The marker may be formed by pressing or, in the case of synthetic resin and composition markers, by moulding or vacuum forming from sheet. Synthetic resin and composition markers may also be prepared by dipping or spraying a mold or a clay pigeon target with a solution, dispersion or other liquid mixture containing the synthetic resin together with any filler. The coating mixture may also contain other conventional components such as colorants and antioxidants. When the liquid mixture is applied to a mould it is subsequently removed therefrom after the fluid components have been removed by drying or solidified by a hardening reaction before fitting to a clay pigeon target. When the liquid mixture is applied directly to a clay pigeon target it is retained thereon after the fluid components have been removed by drying or solidified by a hardening. In either case the substrate may be treated or coated with a release composition which prevents substantial adhesion. In the case of a mould the release composition assists separation of the target marker while in the case of a clay pigeon substrate the release composition ensures separation when the target is shattered by pellet impact.

Where clay pigeon targets fitted with a marker according to the invention are to conform to international standards the marker should preferably weigh less than five grams to maintain the target within the permitted weight tolerance. Such targets have an outer diameter of 110 mm so that the inner diameter of the upwardly directed rim should have a similar diameter and sufficient resilience to accept targets having a rim within the 2 mm tolerance allowed in either direction. To increase resilience the outer rim may carry a series of incisions or slots.

To cause the marker to fall rapidly it may be perforated or include fins, flaps or other surfaces to modify its aerodynamic characteristics. In one version the surface of the marker which does not engage the rim of the clay pigeon target may have more than 50 per cent of its surface area removed by perforations or other voids. In some embodiments the markers may be adapted to vary the aerodynamic properties of the clay pigeon target and introduce deviant flight behaviour requiring greater skill for destruction by a shooter. In a special embodiment variations in the surface contour may optionally include a combination of perforations and fins in a manner that generates sound during launch and/or flight. In a particularly preferred embodiment the central portion of the upper surface of the marker carries moulded depressions or fins to modify its flight behaviour.

The thickness of the marker depends to a large extent on the strength and density of the material used for its fabrication. Where a marker if formed from sheet material a thickness of 0.25 to 0.75 mm may be used for fabrication with a preferred range of 0.5 to 0.3 mm. In the case of high impact polystyrene a thickness of 0.4 mm performs in an excellent manner.

In order that the invention may be clearly understood it will now be described with reference to the accompanying drawings in which:

FIG. 1 is a perspective view of a clay pigeon target,

FIG. 2 is a perspective view of one embodiment of a marker for use with a clay pigeon target accordance with the invention, FIG. 3 is a perspective view of an alternative embodiment of a marker for use with a clay pigeon target in accordance with the invention, FIG. 4 is a perspective view of a further, embodiment of a marker for use with a clay pigeon target in accordance with the invention, and FIG. 5 is a perspective view of another embodiment of a marker for use with a clay pigeon target in accordance with the invention.

Figure 1:
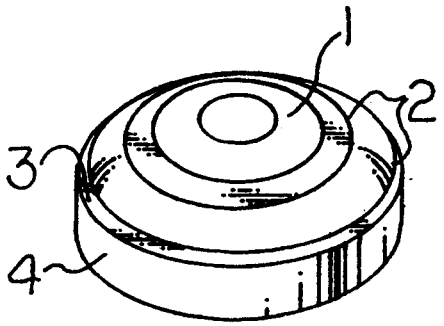

A standard form of clay pigeon target, see FIG. 1, comprises a saucer shaped disc formed of a frangible material and having a domed upper surface 1 carrying a series of ridges 2 ending with a substantially flat edge portion 3. The disc has a peripheral rim 4 with a substantially cylindrical outer surface.

The interior of the disc, not shown, has a smooth, substantially domed, sur face matching the upper surface 1. The surface of the inner portion of the peripheral rim 4 may match the outer sur face or have an inward slope so as to give the rim a tapered form. In many applications the targets are stacked vertically in the magazines of launchers and must fit loosely. The inner edge of the rim 4 rests on the flat edge portion 3 of a target located below it in the magazine. In its internationally agreed form the rim 4 has a diameter of 110 mm with a tolerance of plus or minus 2 mm.

Figure 2:
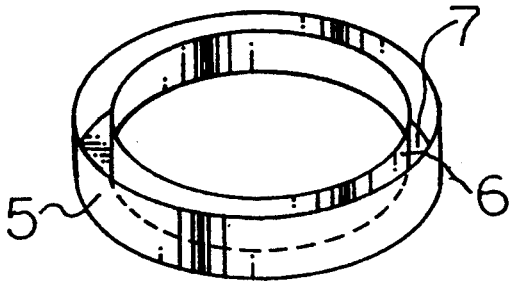

In a first embodiment a marker according to the invention, see FIG. 2, consists of an annular channel having an outer wall 5 and an inner wall 6 rising from a base 7. The marker is fitted to the rim 4 of a clay pigeon target and is held i n position by a combination of frictional forces and vacuum action between the outer surface of the rim 4 and the inner surfaces of the walls 5 and 6. The height of the wall 5 can vary according to the properties of the material used for its fabrication. The outer wall 5 may extend from a quarter to the total height of the rim 4 and even extend above it. In a preferred embodiment a height of half that of rim 4 is chosen for the height of the wall 5.

The target is launched in the usual manner and when hit the target shatters into a number of fragments while the marker falls to the ground substantially intact. Markers falling in a specified area may be collected after shooting has finished and used as the basis for assessing a score. If a series of shooters is involved the markers may be identified by using different colours or code markings to designate each shooter.

Figure 3:
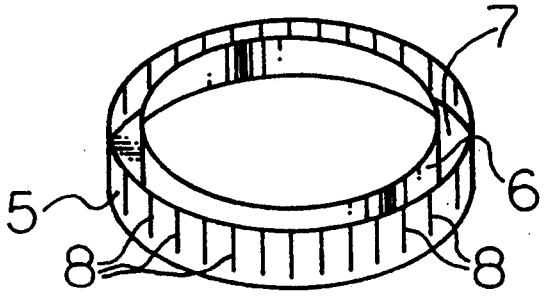

In an alternative embodiment, see FIG. 3, the outer wall 5 of the marker carries a series of incisions 8 which enables the marker to accomodate a wider range of rim thicknesses and eccentricities than those with a solid wall. Alternatively the incisions may be widened to form a castellated ring.

Figure 4:
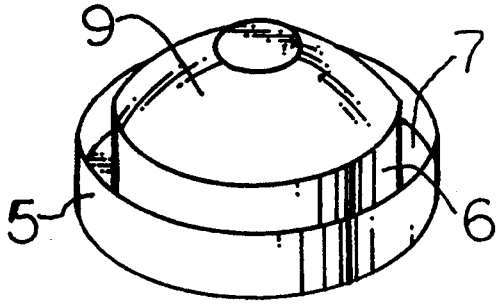

In a further embodiment, see FIG. 4, a dome 9 is circumferentially attached to the inner wall 6 of the marker.

This embodiment is easier to locate visually when lying on the ground. The dome 9 may carry fins, flaps or be formed in a manner which provides aerodynamic interference. In a particularly preferred form markers of the type shown in FIG. 4 were fabricated from high impact polystyrene sheet by the vacuum forming process. The sheet had a thickness of 0.75 mm before forming in some samples but others having a thickness in the range of 0.5 to 0.4 mm were found to be more easily penetrated by pellets and preferred.

Figure 5:
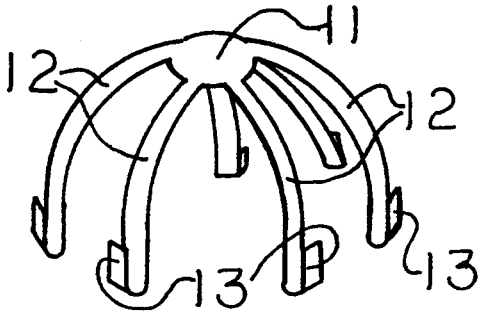

The target may comprise a central disc-shaped core 11, see FIG. 5, carrying a plurality of legs 12 attached or formed with the core 11. The legs 12 are directed outwardly and terminate in feet 13 adapted to engage the rim of a standard clay pigeon target, not shown, by frictional and/or adhesive forces. The feet 12 in the embodiment illustrated engage the outer surface 4 of the rim of a clay pigeon target and are retained by frictional forces.

Figure 6:
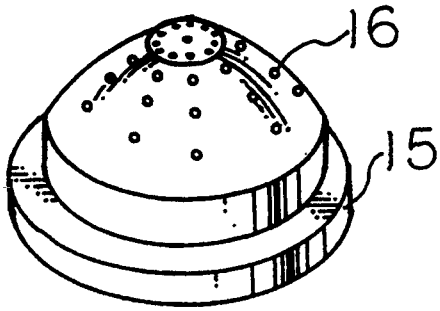
FIG. 6 is a perspective view of another embodiment of a marker for use with a clay pigeon target in accordance with the invention, which caps the target.
Figure 7:
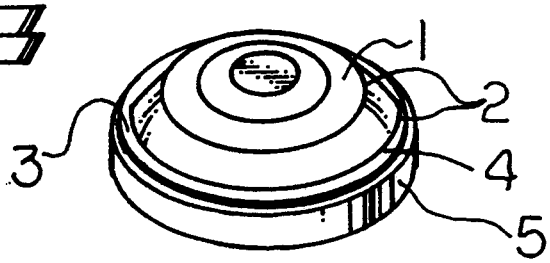
FIG. 7 is a perspective view of an embodiment of a marker for use with a clay pigeon target, attached in combination with the clay pigeon target, in accordance with the invention.

In yet another embodiment of the invention, see FIG. 6, the marker may comprise a cap 14 which extends over the whole of the upper surface of a clay pigeon target and is retained by a peripheral downwardly directed wall 15 which is held by frictional and/or vacuum forces by the outer rim of the target. The upper surface of the cap may contain perforations 16 or be constructed as a grid or net so as to reduce the weight and reduce interaction with pellets directed at the target. In FIG. 7 is illustrated a marker in combination with a target, in accordance with the present invention as described herein.

I claim:

1. An article of manufacture comprising a marker for a clay pigeon target having a dished disk having an upwardly curving central portion which can fit into the underside of a clay pigeon target and an upwardly directed wall which has an internal diameter substantially the same as the outer rim of such a target and which is maintainable in position in the target by a force to include vacuum force between the upwardly facing surface of the central portion of the marker and the underside of the target.

2. The article as claimed in claim 1, characterised in that it further comprises the clay pigeon target attached to the marker.

3. The article as claimed in claim 2, characterised in that the marker contains high impact polystyrene formed from sheet having a thickness in the range of 0.4 to 0.5 mm, and the marker weighs less than five grams.

4. The article as claimed in claim 1, characterised in that the marker is constructed from a material with sufficient resilience to engage the rim of the target, and which marker does not shatter.

5. The article as claimed in claim 1, characterised in that the marker contains a synthetic resin polymer.

6. The article as claimed in claim 5, characterised in that the synthetic resin polymer is high impact polystyrene.

7. The article as claimed in claim 5, characterised in that the marker is distinctively coloured.

8. The article as claimed in claim 5, characterised in that the marker is formed from sheet.

9. The article as claimed in claim 8, characterised in that the marker is formed from sheet having a thickness in the range of 0.25 to 0.75 mm.

10. The article as claimed in claim 9, characterised in that the marker is formed from sheet having a thickness in the range of 0.3 to 0.5 mm.

11. The article as claimed in claim 5, characterised in that the marker is formed from a liquid mixture.

12. The article as claimed in claim 11, characterised in that a release agent is suitably employed.

13. The article as claimed in claim 5, characterised in that the marker weighs less than five grams.

14. A marker for a clay pigeon target comprising a ring of resilient material having a wall adapted to engage a rim of a standard clay pigeon target, characterised in that said marker takes the form of a simple annulus having inner and outer upwardly directed walls which can engage the lower rim of the target and be maintained in position by frictional contact between the walls and the rim, and in that the wall engaging outwardly the rim of a clay pigeon target carries a series of vertical voids.

15. A marker for a clay pigeon target comprising a ring of resilient material having a wall adapted to engage outwardly a rim of a standard clay pigeon target, and a dome surface connected to the ring, which dome surface would not engage the rim of the target, characterised in that the dome of the marker is has at least one of the following features: perforations, fins, flaps and other surfaces to modify its aerodynamic characteristics.

16. The marker as claimed in claim 15, characterised in that the dome surface has more than 50 percent of its surface area removed to form voids.

17. The marker as claimed in claim 16, characterised in that it contains a synthetic resin polymer formed from a sheet having a thickness in the range of 0.25 to 0.75 mm, and the marker weighs less than five grams.

18. The marker as claimed in claim 15, characterised in that it has a surface contour which includes a combination of perforations and fins in a manner that can generate sound during at least one of the following occurrences: launch and flight.

19. A marker for a clay pigeon target comprising a dished disk having an upwardly curving central portion cap, which can extend over the whole of the upper surface of a clay pigeon target and a peripheral, downwardly directed wall which has an internal diameter substantially the same as the outer rim of such a target and which is maintainable in position on the target by at least one of the following forces between the downwardly facing surface of the central portion cap of the marker and the upperside of the target: frictional and vacuum.

* * * * *